United States Patent [19]

Goldstein et al.

[11] Patent Number: 5,033,355

[45] **Date of Patent: * Jul. 23, 1991**

[54] METHOD OF AND APPARATUS FOR DERIVING A HIGH PRESSURE, HIGH TEMPERATURE PLASMA JET WITH A DIELECTRIC CAPILLARY

[75] Inventors: Yeshayahu S. A. Goldstein, Gaithersburg; Derek A. Tidman, Silver Spring, both of Md.

[73] Assignee: GT-Device, Alexandria, Va.

[ * ] Notice: The portion of the term of this patent subsequent to May 27, 2003 has been disclaimed.

[21] Appl. No.: 823,096

[22] Filed: Jan. 27, 1986

Related U.S. Application Data

[63] Continuation of Ser. No. 471,215, Mar. 1, 1983, Pat. No. 4,590,842.

[51] Int. Cl.[5] ..... F41B 6/00

[52] U.S. Cl. ..... 89/8; 102/430; 313/231.410; 315/111.210

[58] Field of Search ..... 89/8, 28.05, 16; 102/430, 202, 291; 376/144, 145, 107, 150; 313/231.31, 321.41, 231.51, 362.1; 315/11.21-111.81; 219/121 PS, 121 PP, 121 PM, 121 P; 60/203, 203.1

[56] References Cited

U.S. PATENT DOCUMENTS

| | | | |
|---|---|---|---|
| 667,435 | 2/1901 | Friese-Greene et al. | 89/28.05 |
| 671,708 | 4/1901 | Noble | 102/435 |
| 2,790,354 | 4/1957 | Yoler et al. | 89/8 |
| 2,845,741 | 8/1958 | Day | 89/16 |
| 3,223,822 | 12/1965 | Browning et al. | 219/121 PP |
| 3,233,404 | 2/1966 | Huber et al. | 60/202 |
| 3,318,094 | 5/1967 | Koller | 60/202 |
| 3,335,637 | 8/1967 | Null et al. | 89/8 |
| 3,447,322 | 6/1969 | Mastrup | 60/203 |
| 3,468,217 | 9/1969 | Cooley | 89/8 |
| 3,515,932 | 6/1970 | King | 60/202 X |
| 3,575,003 | 4/1971 | Larocca | 60/203 |
| 3,916,761 | 11/1975 | Fletcher et al. | 89/8 |
| 3,929,119 | 12/1975 | Fletcher et al. | 89/8 X |
| 3,966,487 | 6/1976 | Crane et al. | 106/307 |
| 4,269,659 | 5/1981 | Goldberg | 376/107 |
| 4,429,612 | 2/1984 | Tidman et al. | 89/8 |
| 4,507,589 | 3/1985 | Prono | 313/231.01 X |
| 4,590,842 | 5/1986 | Goldstein et al. | 89/8 |
| 4,711,154 | 12/1987 | Chryssomallis et al. | 89/7 |

FOREIGN PATENT DOCUMENTS

| | | | |
|---|---|---|---|
| 1067946 | 10/1959 | Fed. Rep. of Germany | 376/144 |
| 1278970 | 9/1968 | Fed. Rep. of Germany | 60/202 |
| 1564123 | 2/1970 | Fed. Rep. of Germany | 315/111.21 |
| 2350719 | 4/1975 | Fed. Rep. of Germany | 60/202 |

OTHER PUBLICATIONS

Stambler, Irwin, "Exploding Wires", Space/Aeronautics, Sep. 1960, pp. 48-51.

Chace et al., Exploding Wires, vol. 3, 1964, pp. 1-7, 211-222, 339-351.

Bernard Grob, Basic Electronics, 1984, obverse of title page.

Webster's New World Dictionary of the American Language, 1957, pp. 1638, 1272.

George L. Clark, The Encyclopedia of Chemistry, 1966, p. 626.

The Aircraft Gas Turbine Engine and its Operation, Dec. 1982, pp. 92-94, "Convergent-Divergent Exhaust Nozzle".

Bernard Grob, Basic Electronics, 1984, pp. 249-250.

E. Z. Ibrahim, "The Ablation Dominated Polymethylmethacrylate Arc", Appl. Phys., 13 (1980), pp. 2045-2065.

B. V. Bondarev et al., "One-Dimensional Theory of Capillary Discharge with Vaporizing Walls", Teplofizika Vysokikh, May-Jun., 1977, pp. 465-470.

Robert G. Jahn, Physics of Electric Propulsion, 1968, pp. 116-127, 148-153.

R. J. Vondra et al., "Analysis of Solid Teflon Pulsed Plasma Thruster", Dec. 1970.

*Primary Examiner*—Stephen C. Bentley

*Attorney, Agent, or Firm*—Lowe, Price, LeBlanc, Becker & Shur

[57] ABSTRACT

A pulsed high pressure, supersonic plasma jet for accelerating a projectile through an elongated confined bore is derived from a dielectric structure including a capillary passage having an interior wall surface from which plasma forming material is ablated in response to a discharge voltage applied to first and second electrodes respectively forming a nozzle and plug at opposite ends of the passage. The nozzle injects the plasma into the bore behind the projectile.

54 Claims, 2 Drawing Sheets

METHOD OF AND APPARATUS FOR DERIVING A HIGH PRESSURE, HIGH TEMPERATURE PLASMA JET WITH A DIELECTRIC CAPILLARY

This is a continuation of application Ser. No. 471,215, filed Mar. 1, 1983, now U.S. Pat. No. 4,590,842.

TECHNICAL FIELD

The present invention relates generally to a method of and apparatus for accelerating a projectile and more particularly to accelerating a projectile along an enclosed path by supplying a high velocity, high pressure plasma jet behind the projectile derived from a dielectric defining a capillary passage wall responsive to a discharge voltage.

BACKGROUND OF THE INVENTION

In our co-pending, commonly assigned application, Ser. No. 049,557, filed June 18, 1979, entitled "Method and Apparatus for Accelerating A Solid Mass", now U.S. Pat. No. 4,429,612, there is disclosed an apparatus for and method of accelerating masses ranging from fractions of a gram to kilograms to velocities in the range of approximately $10^2$ kilometers per second. The solid mass, preferably in the form of a projectile, is accelerated along a predetermined path by passing an electric discharge through a plasma layer adjacent the projectile surface layer. The discharge plasma is imploded against the projectile surface layers so the plasma arrives on a region of the peripheral projectile surface layer to impart force components to the projectile along and normal to the path, to thereby accelerate the projectile in free flight along the path. To achieve stable, free flight acceleration along the path, the plasma arrives at the region on opposite sides of the peripheral surface with substantially equal forces so the normal components are balanced and the projectile is accelerated by the axial components. The projectile region against which the forces act is a surface of revolution about a longitudinal axis of the plasma and the plasma has a circular inner imploding periphery at right angles to the axis when it arrives at the surface.

To accelerate the projectile to velocities in the stated range, the projectile must interact with the imploding plasma over a relatively long distance, such as approximately one meter to several hundreds of meters, or even greater distances if higher velocities are desired. To achieve stable acceleration over this considerable length, implosion of the plasma is synchronized with acceleration of the projectile along the path so arrival of the plasma on the peripheral projectile region is matched with movement of the projectile along the path. Preferably, the synchronism is obtained by initiating separate plasma discharges at spaced regions along the path. The discharges are timed so they are initiated at the spaced regions downstream of the projectile prior to the projectile arriving at the regions and impact on the surface of the projectile. The separate discharges may be initiated in response to a position detector for the projectile along the path.

It has been found that the method and apparatus disclosed in our previously mentioned co-pending application does not efficiently accelerate a projectile at relatively low velocities, i.e., less than 15 kilometers per second. It is, therefore, an object of the present invention to provide a new and improved apparatus for and method of accelerating a projectile from virtually at rest to a velocity that could range up to about 50 kilometers per second.

Another object of the invention is to provide a new and improved apparatus for and method of accelerating a projectile from virtually a rest condition to a velocity at which it can be efficiently accelerated by the prior art structure to a velocity in the range of $10^2$ kilometers per second.

DISCLOSURE OF THE INVENTION

In accordance with the present invention, a projectile is accelerated along a confined path having a longitudinal axis by supplying a pulsed high pressure, high velocity plasma jet to the path in such a manner that the plasma is applied to the rear of the projectile to accelerate the projectile as it traverses the path.

The plasma jet stream is derived by a structure including a tube having a passage with a longitudinal axis. The tube includes an interior passage defining dielectric wall including an ionizable substance. A voltage applied between spaced longitudinal regions of the passage causes the substance to be ablated and ionized to form the plasma inside of the tube. The passage is dimensioned as a capillary, i.e., the diametric distance across the passage is substantially less than the distance between the spaced regions, so that plasma formed therein has high velocity and high pressure to form each of the jet streams. One end of the passage has a flared orifice into the confined path to reduce tendency of the pulsed plasma jet to spread after it leaves the nozzle. The other end of the passage is blocked to prevent the flow of plasma through it.

In a preferred embodiment, the ionizable substance includes a carbon hydrogen composition, such as polyethylene. The hydrogen and carbon in the composition are ionized in response to the applied voltage to form the high velocity, high pressure plasma. A consumable dielectric wall containing hydrogen, such as polyethylene, is particularly advantageous because of the low molecular weight of the ionized substance.

The plasma capillary discharge ducts terminate in expansion nozzles that direct the plasma jets into the acceleration path. The nozzles provide plasma jet velocities of about 2 times the plasma sound speed inside the capillary discharge, i.e., convert the internal thermal energy stored in the plasma into directed flow kinetic energy of the plasma jets. These plasma jets should also have a flow velocity of approximately twice the projectile velocity to most efficiently accelerate the projectile by impinging on its rear surface. The projectile acceleration essentially occurs via the transfer of directed flow kinetic energy and momentum in the plasma jets to the projectile kinetic energy and momentum.

Expansion of the capillary discharge plasma out through an outwardly flared expansion nozzle also has the important effect of cooling the plasma so that it becomes a supersonic cool jet of plasma. This in turn reduces heat transfer to the path confining walls of the accelerator which reduces ablation of wall material so that the lifetime of the accelerator for repeated use is greatly increased.

For low velocities, less than about 10 kilometers per second, the projectile is formed as a surface of revolution having a diameter equal to the cross-sectional diameters of the confined path so that it is wall-confined. However, for velocities in excess of about 10 kilometers per second, the projectile preferably has a diameter slightly smaller than the cross-sectional diameter of the confined path, so that the projectile can be accelerated in free flight through the confined path, thereby reducing friction between the projectile and walls of the confined path. Because of this factor, the high pressure, high velocity plasma applied to the rear of the high velocity projectile, has a tendency to escape from around the projectile, forward of the projectile. The resulting, escaping gas forward of the projectile may cause false triggering of a detector for the position of the projectile, and can cause a pressure increase in front of the projectile, to reduce the projectile forward speed. To obviate such deleterious effects, the confined path in the high velocity region includes openings, e.g., in the form of slots or circular apertures, between each adjacent pair of longitudinal regions, to vent the high pressure, high velocity gas into a vacuum region surrounding the confined path. Preferably, the openings between each adjacent pair of longitudinal regions have a total area of at least twice the cross-sectional area of the interior of the confined path and the openings are located between each longitudinal region where the jet is injected and the detector immediately downstream of the region.

The acceleration region and plasma discharge ducts are evacuated to a sufficiently low vacuum pressure so that electrical breakdown of the discharges can be promptly obtained on application of a high voltage. The pressure is a function of the capillary dimensions (length and diameter) and the atomic species of the gas fill prior to firing.

Another object of the present invention is to provide a new and improved method of initiating plasma discharges from consumable wall, capillary plasma sources utilized for accelerating projectiles to high velocity.

A further object of the present invention is to provide a high velocity projectile accelerator including an accelerating expansion of plasma flow through nozzles so that the plasma thermal energy is more efficiently converted into jet kinetic energy while at the same time cooling the plasma in the jets so that reduced ablation of the accelerator walls adjacent the jets occurs, thereby increasing the lifetime of the device for repeated firing.

We are aware of Yoler et al, U.S. Pat. No. 2,790,354. In Yoler et al is disclosed a mass accelerator employing an enclosed wall structure that rapidly releases great quantities of light gas, preferably hydrogen, when subjected to heating by a current pulse of an electric arc. In response to release of the great quantities of gases from within the enclosure and behind a mass being accelerated, the pressure of propelling gases is increased, to propel the mass to a high velocity. In the structure of Yoler et al the plasma pressure is trapped in the barrel section behind the projectile so the acceleration is essentially the same as that in a conventional gas gun. Such a device would not be capable of accelerating the projectile to a speed in excess of the sound speed in the plasma, as is attained with the present invention. Further, the plasma sound speed in the prior art device decreases rapidly during the time while the projectile is accelerating after the current pulse has been completed due to contact between the hot plasma and the barrel walls. This has the deleterious effect of further limiting the maximum projectile velocity achievable in such a device to values substantially below 10 kilometers per second, as well as damaging the barrel wall via ablation which limits the device lifetime.

In contrast, the present invention initiates a plasma jet from a source remote from the projectile path. The jet acts against the rear of the projectile with a flow velocity of about two times the sound speed of the hot plasma produced during an energizing current pulse so that projectile velocities of up to about 50 kilometers per second are achievable with a higher efficiency since the nozzles convert plasma thermal energy into jet expansion through the nozzle. Expanding the jet through the nozzle enables the device to have a relatively long lifetime because of reduced erosion of walls coming into contact with the plasma. Further, the basic propulsion mechanism in the present invention involves a transfer of directed plasma jet kinetic energy and momentum to the projectile via collision between the plasma and the projectile. This is different from the enclosed plasma gas-gun pressure involved in the device disclosed by Yoler et al which is not suitable for achieving high projectile velocities.

An additional important advantage of the arrangement of the present system is that the radius and length of the capillary discharge can be chosen as parameters independent of the dimensions of the barrel or bore through which the projectile propagates. Capillary discharges having a radius much less than the barrel radius are needed to achieve extremely hot plasmas via ohmic heating due to current flow through the capillary discharge.

The above and still further objects, features and advantages of the present invention will become apparent upon consideration of the following detailed description of several specific embodiments thereof, especially when taken in conjunction with the accompanying drawings.

DETAILED DESCRIPTION OF THE DRAWING

Figure 1:
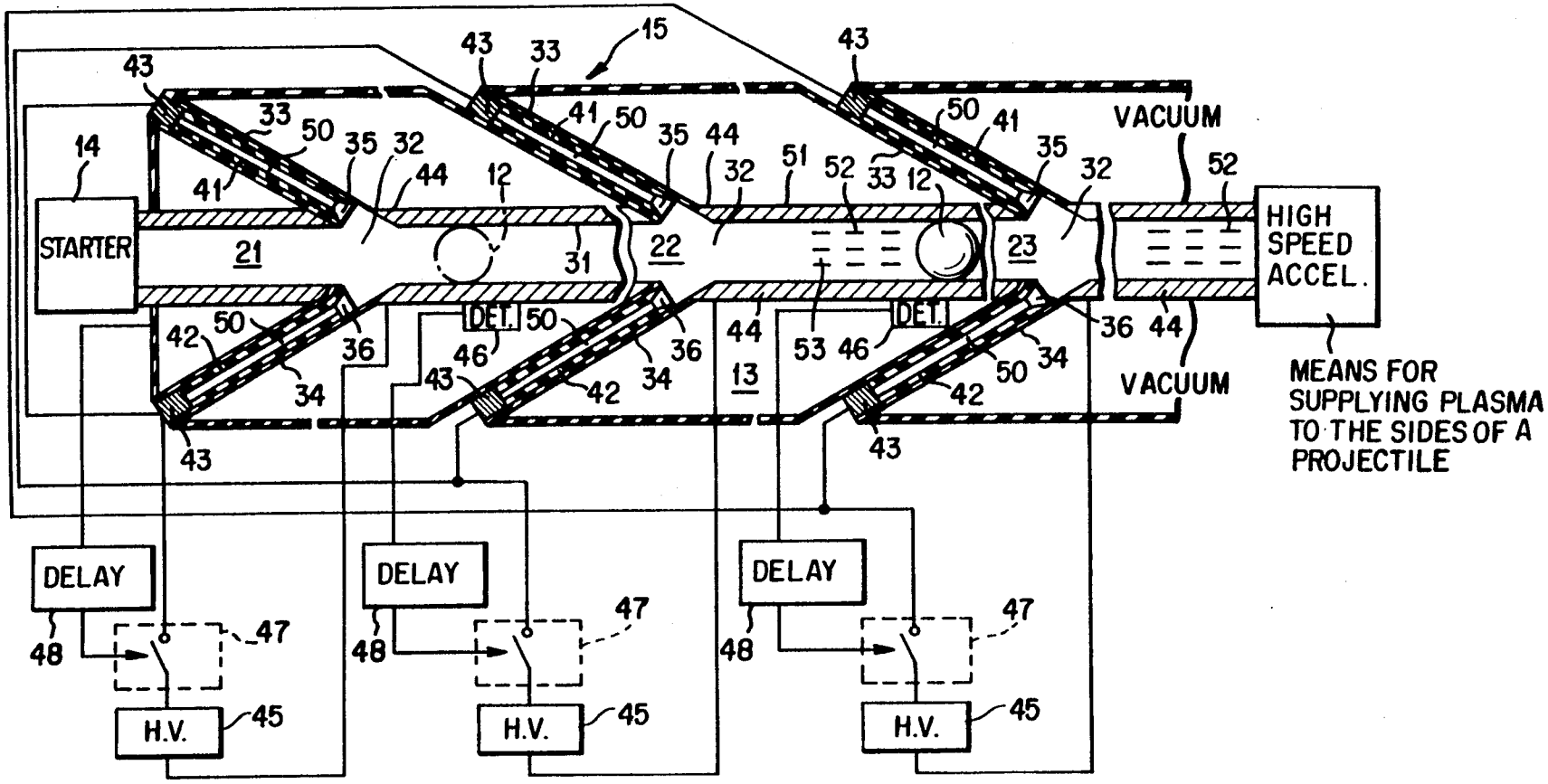
FIG. 1 is a schematic diagram of one preferred embodiment of the present invention.

Reference is now made to FIG. 1 of the drawing wherein there is illustrated an assembly for accelerating projectile 12 to extremely high velocity. The projectile is shown as spherical but could have various shapes. The assembly is located in vacuum chamber 13 and includes three separate sections, namely starter section 14, intermediate section 15 and final accelerator section 16 from which projectile 12 emerges at a very high velocity, such as $10^7$ centimeters per second. Starter section 14 can be a conventional gas gun, a chemical explosive or a plasma source similar to that disclosed in the previously mentioned Yoler et al patent. Downstream of starter 14 are three some-what similar, cascaded accelerating stages 21, 22 and 23 comprising section 15. Downstream of section 15 is section 16, preferably a series of high velocity plasma accelerating stages, such as disclosed in our commonly assigned application, Ser. No. 049,557, filed June 18, 1979, now U.S. Pat. No. 4,429,612. It is to be understood that intermediate section is illustrated as including three stages for purposes of illustration only. In an actual embodiment, tens to hundreds of stages (depending on the application) would typically be included in intermediate section 15; high velocity accelerating section 16 may include as many as thousands of stages.

Projectile 12 is accelerated from rest by starter section 14 so that it enters intermediate section 15 at a velocity of a few (1–3) kilometers per second. In intermediate section 15, projectile 12 is accelerated to free flight to a velocity of approximately 50 kilometers per second in response to high pressure, high velocity plasmas directed to the rear of the projectile. In final accelerating section 16, projectile 12 is accelerated in free flight to a terminal velocity of approximately $10^2$ kilometers per second in response to imploding discharges from the several stages of the final section.

The high velocity plasmas directed to the rear of the projectile in section 15 and imploded onto the projectile in section 16 provide stable, high velocity forward, translatory motion for the projectile. As projectile 12 travels through the initial stages of section 15 it contacts side walls of the initial stages. As projectile 12 reaches higher speeds in the latter stages of section 15 and throughout its travel through section 16, the projectile propagates in free flight, a result achieved by appropriately dimensioning the walls of the latter stages of section 15 and by virtue of an implosion effect of plasma in section 16. Because projectile 12 propagates through the latter stages of section 15 and all of section 16 without wall contact, the high velocity frictional forces exerted on the projectile are minimized.

Each of sections 14, 15 and 16 has a common longitudinal axis along which the center of projectile 12 propagates, while the projectile is in free flight. Because all of the mechanical elements in sections 14, 15 and 16 are basically symmetrical with respect to the common longitudinal axis of the three sections equal forces are applied to the sides of projectile 12 to provide the stable forward motion thereof.

Because cascaded stages 21 and 22 are substantially the same, a description of stage 21 suffices for most of the remaining stages of section 15. Downstream stages 22 and 23 are the same as stage 21, except as described infra. Stage 21 includes a center cylindrical bore 31, coaxial with the common longitudinal axis of sections 14, 15 and 16. The walls of bore 31 define a confined path along which projectile 12 traverses.

Longitudinally propagating pulsed jets of an ionized gas, preferably containing hydrogen, are applied to a common longitudinal region 32 of the confined path formed by the wall of bore 31 by a source including relatively long and thin dielectric tubes 33 and 34 having longitudinal passages that form plasma capillary discharge ducts. The pulsed plasma jets flow to region 32 through outwardly flared orifices or nozzles 35 and 36 at the ends of tubes 33 and 34, respectively. Flared orifices or nozzles 35 and 36 provide plasma jet velocities in region 32 about two times the sound velocity of the plasma in tubes 33 and 34, and approximately twice the velocity of projectile 12. Because the plasma expands as it propagates into region 32 from tubes 33 and 34 through flared orifices or nozzles 35 and 36, the plasma is cooled so it becomes a supersonic, relatively cool plasma jet. Because the jet is cooled as it enters region 32, there is reduced wall ablation of the region and remainder of bore 31, to increase the life time of the accelerator. If material were ablated from the wall of bore 31, i.e. the projectile barrel, the supersonic plasma stream flowing through the barrel would be loaded with high atomic weight materials from the barrel. This material would reduce the plasma speed so that the plasma could not catch up with projectile 12 and push it. To assist in preventing ablation of the projectile barrel, nozzles or orifices 35 and 36 are preferably made of a refractory metal, having high thermal and electrical conductivity, e.g. an alloy of tungsten that can be machined. Also, tubes 33 are preferably made of a strong dielectric that can withstand the extreme pressure of the plasma jet; typical dielectrics for tube 33 are braided glass strands bonded by epoxy or Kevlar.

Tubes 33 and 34 are loaded with replaceable sleeves 41 and 42 so that when sufficient material has been ablated from the sleeves they are replaced, or are continuously replenished by a flow of insulating material into them in the time interval between discharges. The high pressure (typically several thousand atmosphere) plasma jets supplied by the source in tubes 33 and 34 to orifices or nozzles 35 and 36 are derived by forming sleeves 41 and 42 of a carbon-hydrogen compound, such as polyethylene. The carbon-hydrogen compound in tubes 41 and 42 is ionized in response to a high voltage being applied to the compound, resulting in the liberation of hydrogen and carbon plasma. Polyethylene sleeves 41 and 42, respectively containing nozzles 35 and 36, are loaded into dielectric tubes 33 and 34 so that the exterior of each sleeve bears against the wall of the tube associated therewith and is held in place thereby.

Tubes 33 and 34 have a common angular oblique displacement from the longitudinal axis of bore 22. Thus, the longitudinal axes of tubes 33 and 34, as well as sleeves 41 and 42, are displaced by the same non-zero oblique angle from the longitudinal axis of bore 31. Tubes 33 and 34 extend from region 32 toward the rear of the assembly, i.e., toward starter 14. A typical acute angle between the longitudinal axis of bore 31 and each of tubes 33 and 34 is 15°, to facilitate manufacture of the tubes and to assure that the plasma jet pulses supplied by the tubes to bore 31 predominantly have forward velocity, in the direction projectile 12 is being accelerated.

Tubes 33 and 34 are shown as symmetrical with respect to the longitudinal axis of bore 31 and orifices or nozzles 35 and 36 at the ends of the tubes adjacent the bore are longitudinally aligned at region 32 and the pressure and velocity of the plasma jets derived from tubes 33 and 34 are substantially the same. Thereby, force components of the jets passing through orifices or nozzles 35 and 36 transverse to the longitudinal axis of bore 31 are substantially cancelled and force components of the jets in line with the axis of bore 31 are additive. More than two symmetrically arranged tubes can simultaneously supply more than two plasma jets to the same area. Also, it is to be understood that symmetry and transverse force component cancellation are not necessary for proper operation, but that an assymmetric arrangement can be provided, as described in connection with FIG. 2. The additive components of the pulsed plasma jets flowing from tubes 33 and 34 through flared orifices or nozzles 35 and 36 into region 32 combine behind projectile 12 to accelerate the projectile in free flight along the confined path defined by bore 31, away from starter section 14. Because of the angle of the longitudinal axes of the passages in tubes 33 and 34 relative to the longitudinal axis of bore 31, the in line force components from the plasma jets do not have a tendency to flow backwardly, toward starter section 14. Flared nozzles or orifices 35 and 36 overcome, to a certain extent, the tendency of the jets to spread after leaving tubes 33 and 34, i.e., the jets have a tendency to retain constant cross section. The angular relation between the axes of tubes 33 and 34 relative to bore 31 and the tendency of the jets to retain a constant cross section enable virtually all of the additive components of the jets to propagate toward and combine behind projectile 12, to accelerate the projectile along bore 31, away from starter 14.

Figure 2:
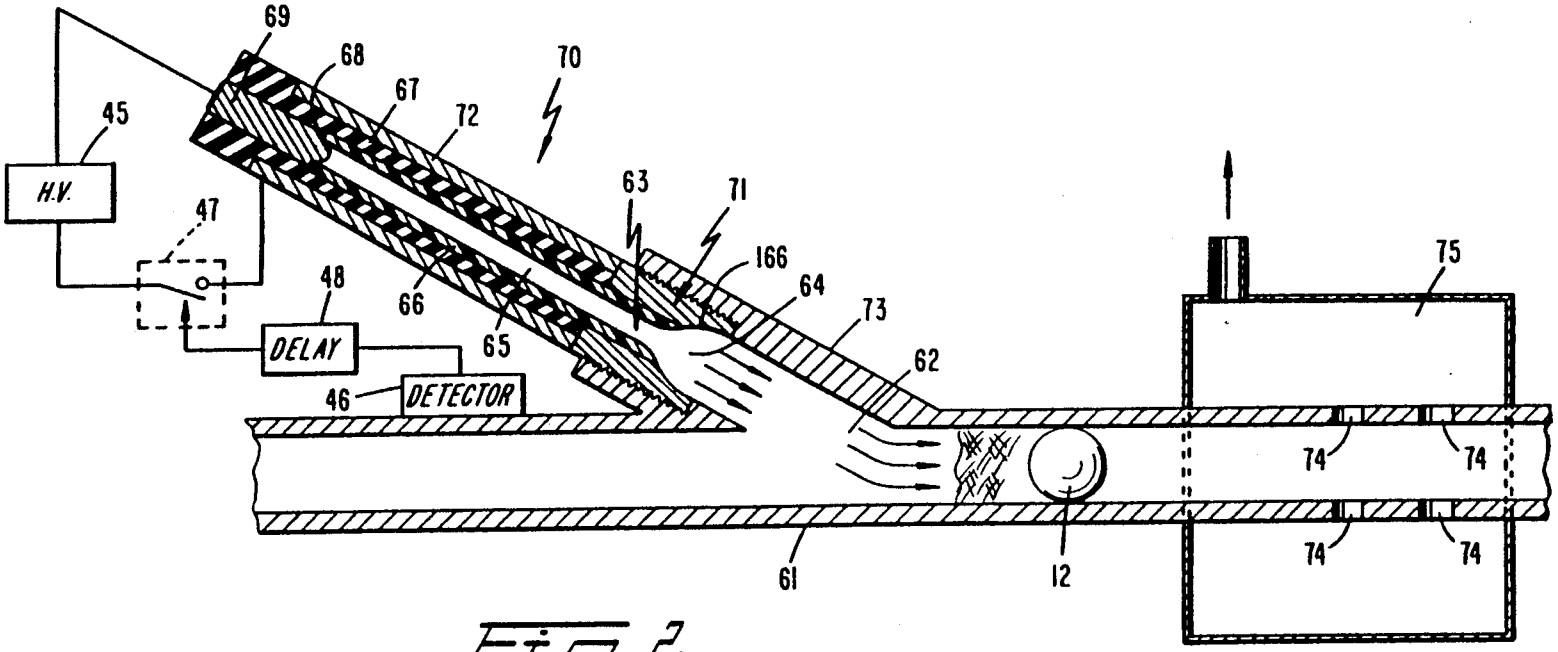
FIG. 2 is a schematic, cross sectional view of one section of a second embodiment of an accelerator in accordance with the present invention, wherein a single oblique discharge tube is included.

Because sleeves 41 and 42 are constructed identically, the following description is given in connection only with sleeve 41. Opposite ends of sleeve 41 are electrically connected to metal electrodes 43 and 44; electrode 44 is electrically connected to metallic nozzle or orifice 35. Electrodes 43 and 44 are selectively connected to opposite terminals of high voltage power supply 45. In response to the voltage of power supply 45 being applied across electrodes 43 and 44 as a result of closure of switch 47, electric breakdown occurs along the length of the inner wall defining the plasma capillary passage of sleeve 41. In the embodiment of FIGS. 1 and 2, the breakdown is facilitated because the interior capillary paths 50 are at a low vacuum pressure within chamber 13.

The breakdown between electrodes 43 and 44 is initiated along the inner wall of dielectric sleeve 41. Once breakdown along the inner wall of sleeve 41 occurs, plasma from the inner wall rapidly implodes radially of tube 33 to fill duct or capillary passage 50, defined by the volume surrounded by the inner diameter of sleeve 41. In response to the plasma filling duct 50, there is formed an electric discharge channel which is effectively a resistor between electrodes 43 and 44. The resistance of the discharge channel can be expressed as:

$$R = \frac{l}{\pi \alpha^2 \sigma},$$

where

R = the resistance between electrodes 43 and 44, l = the length of sleeve 41 between electrodes 43 and 44, $\alpha$ = interior radius of sleeve 41, and $\sigma$ = is the conductivity of the plasma in the thus formed duct.

In response to current flowing through the plasma between electrodes 43 and 44, ohmic dissipation ($I^2R$) in the plasma transfers energy efficiently from a capacitor in high voltage supply 45 into the plasma. The resulting high plasma pressure causes plasma in duct 50 to flow longitudinally of the passage, rapidly out of the nozzle formed by flared orifice 35 at the end of tube 33; the other end of the passage is blocked by electrode 43 to prevent the flow of plasma through it. Simultaneously, radiation emission and thermal conduction transport energy from the plasma in duct 50 to the wall of sleeve 41, to ablate additional plasma from the wall of sleeve 41, to replace plasma ejected through orifice 35. Thereby, material on the interior wall of sleeve 41 is consumed as fuel and ejected as plasma in response to the electric energy provided by high voltage supply 45 when switch 47 is initially closed.

The length l, radius $\alpha$, and atomic species (hydrogen and carbon) in the plasma in sleeve 41 are chosen such that the discharge resistance R exceeds the sum of the resistance of high voltage source 45 and the wires connected between the high voltage source and electrodes 43 and 44. Thereby, energy is efficiently transferred from a capacitor in high voltage supply 45 to the plasma in a relatively short interval, determined by the discharge resistance, as well as inductance and capacitance of high voltage supply 45. Internal energy and the pressure in the plasma formed in tube 33 are converted into kinetic streaming energy by the nozzle formed by flared orifice 35. Typical flow speeds of the pulsed plasma jets supplied through orifice 35 to bore 31 exceed the sound speed of the plasma in tube 33 by a factor of approximately two, i.e., several times, and generally are in the range of several kilometers per second up to about 200 kilometers per second for sleeves 41 formed of polyethylene.

In one preferred, actually manufactured configuration, the passage in polyethylene sleeve 41 has a circular cross section with a radius of 0.15 cm and a length of 10 cm between electrodes 43 and 44 to form a capillary duct. (This is typical of the requirement that the length of the passage between the regions where the discharge voltage is applied be substantially greater than the diametric distance between opposite sides of the passage). Tungsten electrodes 43 and 44 are responsive to 3 kJ of electric energy, at 15 kV, as supplied by capacitive high voltage source 45. In this configuration, approximately $10^{-3}$ cm of $CH_2$ of material is ablated from the inner wall of dielectric sleeve 41 each time the high voltage from source 45 is applied across electrodes 43 and 44. Thereby, after approximately 50 applications of the high voltage to opposite ends of sleeve 41, the capillary, i.e., inner, diameter of sleeve 41 increases appreciably, whereby a new dielectric sleeve must replace the previously utilized sleeve, to provide additional fuel. Alternatively, a liquid surface layer could be injected along or through the wall of tube 33 to provide the ablating plasma source in the tube.

To generate plasma jets suitable for acceleration of projectile 12 to the required range, relatively small currents of a few tens of kiloamperes up to hundreds of kiloamperes are supplied by high voltage source 45 to electrodes 43 and 44. This relatively low current can achieve the desired jet pressure and therefore velocity of projectile 12 because the plasma flowing through duct 50 is decoupled from bore 31 through which projectile 12 accelerates.

To synchronize the pulsed jets supplied by tubes 33 and 34 through orifices 35 and 36 with the translation of projectile 12 through bore 31 so that the in line additive components of the pulsed jets combine at the correct position behind the projectile, the projectile position is sensed by detectors 46, one of which is in each section positioned downstream of region 32. Detector 46 is preferably a magnetic induction detector, responsive to an electrically conducting material located in or forming projectile 12 passing in bore 31 past the detector. However, it is to be understood that other detector types, such as capacitive or optical including light sources and photo cells, could be employed.

Each pulse derived by detector 46 is applied to switch 47 of a downstream stage. Switch 47 has terminals respectively connected between one electrode of high voltage supply 45 and electrode 43. The pulse of detector 46 causes momentary closure of switch 47 for an interval long enough to establish a plasma discharge between electrodes 43 and 44, along the walls of dielectric sleeves 41 and 42. Detector 46 is positioned behind orifices 35 and 36 and region 32 by a sufficient distance to enable switch 47 to be closed and the capacitor in high voltage supply 45 to be discharged across sleeves 41 and 42 and to enable the plasma in tubes 33 and 34 to propagate through orifices 35 and 36 to additively combine and accelerate projectile 12. If necessary, delay network 48 is connected between detector 46 and an actuator for switch 47, to control the time when the pulsed plasma jets are supplied through orifices 35 and 36 to bore 31.

In upstream stage 21, bore 31 has a diameter equal to the diameter of projectile 12 so the projectile contacts the walls of the bore as it is accelerated into the section and out of the section at a speed less than about 15 km/sec. Thereby the high speed plasma gases are confined behind projectile 12 as the projectile is accelerated through stage 21 to the next downstream section. When the projectile speed reaches the range of about 5 to 15 km/sec., it is accelerated to free flight, a result achieved by slightly increasing the diameter of bore 31 in intermediate stage 22 downstream of region 32 and throughout the length of downstream stage 23.

Because projectile 12 has a diameter slightly less than the diameter of bore 31 in intermediate and downstream stages 22 and 23, the plasma acting against the rear surface of the projectile has a tendency to leak around and in front of the projectile. Leaking gases in front of projectile 12 can adversely affect the performance of stages 22 and 23 because such gases if allowed to accumulate have a tendency to decelerate the projectile. To remove the plasma that has leaked around projectile 12, the portion of wall 51 (which forms bore 31) ahead of orifices 35 and 36 in stages 22 and 23 includes apertures 52 which vent the high pressure, high velocity gases in bore 31 to the vacuum in chamber 13. Vent apertures 52 in wall 51 can be formed as circular or elongated slots; in each apertured stage the apertures have a combined area equal approximately to twice the cross-sectional area of bore 31. Vents 52 are located in a portion of wall 51 which can be considered as a drift section, downstream of main interaction region 32, between the pulsed plasma jets propagating through apertures 35 and 36 and upstream of the orifices for the following, cascaded stage of section 15.

Reference is now to made to FIG. 2 of the drawing, a cross-sectional view of one stage of intermediate section 15, in accordance with a second embodiment. In the second embodiment plasma jet streams are derived from asymmetrically located jet nozzle means for producing asymmetric force components transverse to the axis of bore 31. The asymmetric force components are produced at the location where the jet stream enters the confined path. To provide in line additive components behind projectile 12, the firing time of the plasma is controlled so that the projectile is substantially downstream of the jet nozzle when the jet enters the confined path. Thereby, the transverse components do not act against the projectile to any substantial extent. In line components of the jet stream are additive behind the projectile to accelerate it along the bore axis. The asymmetric relation facilitates changing of the plasma sources, enabling them all to be located on a single side of the assembly.

To these ends, the section illustrated in FIG. 2 includes a metal, refractory barrel 61 having a longitudinal axis along which projectile 12 travels. On one side of the wall of barrel 61 is nozzle 62 at the end of passage 63, having a longitudinal axis displaced by an acute angle from the longitudinal axis of barrel 61. Passage 63 includes an enlarged, flared end portion 64 and an elongated, small diameter, capillary portion 65, both located in assembly 70 that is selectively inserted into and removed from stub 73, integral with barrel 61. Wall 166 between end portion 64 and capillary portion 65 has a smooth transition so the plasma flows evenly out of capillary portion 65, enabling all segments of the plasma jet flowing into barrel 61 through nozzle 62 to have substantially uniform speed and temperature.

In capillary portion 65 is polyethylene tube 66, the plasma source for the supersonic plasma jet that flows from end portion 64 through nozzle 62 into the bore of barrel 61. Polyethylene tube 66 has an exterior wall that abuts against a wall of a longitudinal bore of dielectric sleeve 67.

Opposite ends of polyethylene tube 66 are electrically connected to metal, cylindrical cathode 69 and to anode 71, preferably fabricated from a refractory metal. Anode 71 includes wall transition 166 and thereby functions as a nozzle for deriving the supersonic plasma jet stream flowing from capillary passage portion 65. A portion of anode 71 includes metal cylindrical portion 72, which can be integral with the nozzle end of the electrode or can be suitably mechanically connected to the nozzle end. Cathode 69 plugs the bore of dielectric sleeve 67 to assist in holding polyethylene sleeve 66 in place, and prevent the escape of plasma gases from the end of capillary passage portion 65 opposite from nozzle end portion 64.

Polyethylene tube 66 is also held in place by a shoulder on dielectric sleeve 67 at the intersection of tube 66, sleeve 67 and cathode 69. Polyethylene tube 66, dielectric sleeve 67 and all segments of electrodes 69 and 71 are coaxial with the axis of passage 63. To enable assembly 70, including tube 66, sleeve 67, and electrodes 69 and 71, to be easily inserted into and withdrawn from one side of barrel 61, the barrel includes an oblique, annular stub 73, having a threaded, cylindrical bore into which electrode 71 is screwed. This arrangement facilitates insertion and removal of assembly 70, a desirable feature to facilitate insertion of a new polyethylene tube 66 or an entire assembly in the event that any component in the assembly breaks.

To control ignition of plasma from polyethylene tube 66, a voltage is applied between electrodes 69 and 71 at opposite ends of the tube. To these ends, detector 46 is mounted on the exterior of barrel 61 upstream of nozzle 62. Detector 46 supplies a signal to switch 47 via delay circuit 48 to apply the high voltage of source 45 between electrodes 69 and 71, as described supra, in connection with FIG. 1.

However, the time when voltage is applied between electrodes 69 and 71, to derive the supersonic plasma jet flowing through nozzle 62, differs in the FIG. 2 embodiment from that in the FIG. 1 embodiment. In the FIG. 1 embodiment, the plasma firing is timed so that the supersonic plasma jet enters bore 31 just as projectile 12 is leaving region 32. In the FIG. 1 embodiment, such timing is possible because of the symmetrical nature of the plural jet pulses applied to bore 31 at a particular location along the bore.

In the embodiment of FIG. 2, however, the transverse force components of the supersonic plasma jet flowing through nozzle 62 into the bore of barrel 61 are asymmetrical. If the asymmetrical force components immediately act on projectile 12, the projectile would have a tendency to be urged against the wall of barrel 61 opposite from nozzle 62. To avoid such a tendency, delay circuit 48 is adjusted so that plasma is fired from polyethylene tube 66 at a time such that the supersonic plasma jet flows through nozzle 62 when projectile 12 is somewhat downstream of the nozzle, whereby only axial components of the supersonic plasma jet are applied to the rear of projectile 12. The in line components applied to the rear of projectile 12 are applied equally across the rear surface of the projectile, so that the embodiment of FIG. 2 is applicable to the low velocity situation, wherein projectile 12 engages the wall of metal barrel 61, as well as to the high velocity situation wherein projectile 12 is in free flight between the walls of the barrel.

Downstream of nozzle 62 and the point along barrel 61 where the supersonic plasma jet flowing through the nozzle initially acts against the rear of projectile 12 to accelerate the projectile, gas is vented from the bore of barrel 61. To these ends, apertures 74 are provided in the wall of barrel 61. Gas in the plasma jet in the bore of barrel 61 flows through apertures 74 into vacuum chamber 75, which surrounds the exterior wall of barrel 61. Chamber 75 is connected to a suitable vacuum source (not shown) to provide the same results described supra, in connection with vents 52, FIG. 1.

While there have been described and illustrated several specific embodiments of the invention, it will be clear that variations in the details of the embodiments specifically illustrated and described may be made without departing from the true spirit of the invention as defined in the appended claims.

We claim:

1. Apparatus for accelerating a projectile comprising means for deriving a high temperature, high pressure pulsed supersonic plasma jet from a dielectric ionizable substance, said jet deriving means including a structure having an interior dielectric wall surface forming a capillary passage, high voltage power supply means for applying a discharge voltage between spaced regions along the length of the interior wall surface while the dielectric ionizable substance extends longitudinally along the wall surface completely between the regions to form a capillary discharge between the regions, the dielectric substance including at least one atomic element that is ionized to form a plasma in response to the discharge voltage from the high voltage power supply means being applied between the spaced regions, the plasma being formed in the passage in response to the substance being ionized between the spaced regions by the discharge voltage applied by the high voltage power supply means between the spaced regions, the diametric length across the passage being short relative to the distance between the spaced regions, first and second ends of the passage being arranged while the discharge voltage is applied between the spaced regions to respectively enable and prevent the flow of plasma through them, the plasma in the passage forming an electric discharge channel between the spaced regions while the discharge voltage is applied between the regions, the capillary passage being configured and the spaced regions being positioned so ohmic dissipation occurs in the electric discharge channel in response to the discharge voltage being applied between the spaced regions to produce a high pressure in the passage, the pressure being sufficiently high and the capillary passage being configured to cause the plasma in the passage to flow longitudinally in the passage and with supersonic speed through the first end to form the pulsed plasma jet; and means forming an elongated confined bore having an inlet downstream of the first end so that the supersonic pulsed plasma jet flows through the first end into the bore, the pulsed plasma jet flowing into the bore behind the projectile to produce a high pressure against the rear of the projectile, the high pressure gas acting on the rear of the projectile having sufficient pressure against the rear of the projectile to accelerate the projectile through a substantial length of the bore.

2. The apparatus of claim 1 wherein the structure is solid and includes the dielectric and the element is ablated and ionized from the solid on the wall surface to form the plasma.

3. The structure of claim 2 wherein the voltage applying means includes a first electrode forming the first end and a second electrode plugging the second end.

4. The apparatus of claim 1 wherein the substance is confined by the wall surface so it does not extend into the passage until it is ionized by the discharge voltage to form the plasma.

5. The apparatus of claim 4 wherein the substance is solid.

6. The apparatus of claim 4 wherein the substance is solid and the element is ablated and ionized from the solid by the discharge voltage.

7. The apparatus of claim 1 wherein the first end is formed as an outwardly flared nozzle through which the jet is injected into the confined bore so the jet expands and cools as it enters the bore.

8. The apparatus of claim 1 further including a high voltage supply connected to the means for applying, the high voltage supply and the means for applying having a first known resistance, the discharge in the channel between the spaced regions while the plasma is formed having a second known resistance, the second resistance exceeding the first resistance so energy is efficiently and rapidly transferred from the high voltage supply to the plasma.

9. The apparatus of claim 1 wherein the substance is a liquid.

10. The apparatus of claim 1 wherein the bore has a metal wall within which the projectile moves.

11. The apparatus of claim 1 further including dielectric sleeve means surrounding and abutting against exterior wall means of the structure having the interior dielectric ionizable substance, the dielectric sleeve means being formed of means for withstanding the pressure produced by the plasma in the capillary passage.

12. The apparatus of claim 11 further including metal cylinder means surrounding and abutting against exterior wall means of the dielectric sleeve means.

13. Apparatus for accelerating a projectile comprising means for deriving a high temperature, high pressure, supersonic plasma jet, said means including: a structure having a capillary passage having a longitudinal axis and an elongated wall having an interior wall surface defining a boundary of the passage, an ablatable dielectric ionizable substance being at and directly behind the wall surface, first and second electrodes at spaced locations along the length of the wall, high voltage power supply means for applying a discharge voltage to the first and second electrodes to form a capillary discharge between the electrodes, the dielectric substance including at least one atomic element that is ionized to form a plasma in response to the discharge voltage from the high voltage power supply means being applied between the electrodes, the plasma being formed by the substance imploding radially into the passage from the wall surface in response to the substance being ionized between the electrodes by the discharge voltage from the high voltage power supply means applied between the electrodes, the diametric length across the passage being short relative to the distance between the electrodes, first and second ends of the passage being arranged while the discharge voltage from the high voltage power supply means is applied between the electrodes to respectively enable and prevent the flow of plasma through them, the plasma in the passage forming an electric discharge channel between the electrodes while the discharge voltage from the high voltage power supply means is applied between the electrodes, the capillary passage being configured and the electrodes being positioned so ohmic dissipation occurs in the electric discharge channel in response to the discharge voltage from the high voltage power supply means being applied between the electrodes to produce a high pressure in the passage, the pressure being sufficiently high and the capillary passage being configured to cause the plasma in the passage to flow longitudinally in the passage and through the first end to form the supersonic pulsed plasma jet; and means forming an elongated confined bore having an inlet downstream of the first end so that the supersonic pulsed plasma jet flows through the first end into the bore, the pulsed plasma jet flowing into the bore behind the projectile to produce a high pressure gas that acts against the rear of the projectile, the high pressure gas acting on the rear of the projectile having sufficient pressure against the rear of the projectile to accelerate the projectile through a substantial length of the bore.

14. The apparatus of claim 13 wherein the first electrode forms the first end and includes a passage so that the plasma jet flows through the first electrode and the second electrode plugs the second end.

15. The elongated apparatus of claim 14 wherein the wall and the ablatable dielectric substance are solid.

16. The apparatus of claim 13 wherein the dielectric substance extends completely between the electrodes.

17. The apparatus of claim 13 wherein the first end is formed as an outwardly flared nozzle through which the jet is injected into the confined bore so that jet expands and cools as it enters the confined bore.

18. The apparatus of claim 17 wherein the first electrode forms the first end and includes a passage so that the plasma jet flows through the first electrode.

19. The apparatus of claim 18 wherein the second electrode plugs the second end.

20. The apparatus of claim 13 wherein hydrogen is an atomic element in the wall that is ionized.

21. The apparatus of claim 13 further including a high voltage supply connected to the means for applying the high voltage supply and the means for applying having a first known resistance, the discharge in the channel between the spaced regions while the plasma is formed having a second known resistance, the second resistance exceeding the first resistance so energy is efficiently and rapidly transferred from the high voltage supply to the plasma.

22. The apparatus of claim 21 wherein the bore has a metal wall within which the projectile moves.

23. The apparatus of claim 13 wherein the substance is a liquid.

24. The apparatus of claim 13 wherein the bore has a metal wall within which the projectile moves.

25. The apparatus of claim 13 further including dielectric sleeve means surrounding and abutting against exterior wall means of the structure having the interior dielectric ionizable substance, the dielectric sleeve means being formed of means for withstanding the pressure produced by the plasma in the capillary passage.

26. The apparatus of claim 21 further including dielectric sleeve means surrounding and abutting against exterior wall means of the structure having the interior dielectric ionizable substance, the dielectric sleeve means being formed of means for withstanding the pressure produced by the plasma in the capillary passage.

27. The apparatus of claim 25 further including metal cylinder means surrounding and abutting against exterior wall means of the dielectric sleeve means.

28. The apparatus of claim 26 further including metal cylinder means surrounding and abutting against exterior wall means of the dielectric sleeve means.

29. Apparatus for accelerating a projectile comprising means for deriving a high temperature, high pressure pulsed supersonic plasma jet from a dielectric ionizable substance, said means including: a structure having an interior dielectric wall surface forming a capillary passage, high voltage power supply means for applying a discharge voltage between spaced regions along the length of the interior wall surface while the substance extends longitudinally along the wall surface between the regions to form a capillary discharge between the regions, the dielectric substance including at least one atomic element that is ionized to form a plasma in response to the discharge voltage from the high voltage power supply means being applied between the spaced regions, the plasma being formed by the substance radially imploding into the passage from the wall surface in response to the substance being ionized between the spaced regions by the discharge voltage from the high voltage power supply means applied between the spaced regions, the diametric length across the passage being short relative to the distance between the spaced regions, first and second ends of the passage being arranged while the discharge voltage from the high voltage power supply means is applied between the spaced regions to respectively enable and prevent the flow of plasma through them, the plasma in the passage forming an electric discharge channel between the spaced regions while the discharge voltage from the high voltage power supply means is applied between the regions, the capillary passage being configured and the spaced regions being positioned so ohmic dissipation occurs in the electric discharge channel in response to the discharge voltage from the high voltage power supply means being applied between the spaced regions to produce a high pressure in the passage, the pressure being sufficiently high and the capillary passage being configured to cause the plasma in the passage to flow longitudinally in the passage and through the first end to form the pulsed supersonic plasma jet; and means forming an elongated confined bore having an inlet downstream of the first end so that the supersonic pulsed plasma jet flows through the first end into the bore, the pulsed plasma jet flowing into the bore behind the projectile to produce a high pressure gas that acts against the rear of the projectile, the high pressure gas acting on the rear of the projectile having sufficient pressure against the rear of the projectile to accelerate the projectile through a substantial length of the bore.

30. The apparatus of claim 29 further including a high voltage supply connected to the means for applying the high voltage supply and the means for applying having a first known resistance, the discharge in the channel between the spaced regions while the plasma is formed having a second known resistance, the second resistance exceeding the first resistance so energy is efficiently and rapidly transferred from the high voltage supply to the plasma.

31. The apparatus of claim 21 wherein the substance is a liquid.

32. Apparatus for accelerating a projectile comprising means for generating a high temperature, high pressure supersonic pulsed plasma jet, said means including: a structure having a capillary passage with an interior dielectric wall surface, the passage having a first open end, a second end and a longitudinal axis, high voltage power supply means for applying a discharge voltage between spaced regions along the length of the interior dielectric wall surface while (a) a dielectric ionizable substance is along the wall surface, (b) the first end of the passage is open and (c) the second, opposite end of the passage is arranged so fluid flow from the passage through it is substantially prevented, the discharge voltage from the high voltage power supply means causing a breakdown along the wall surface, the distance along the longitudinal axis between the spaced regions being great relative to the diametric length of the passage, the breakdown causing the substance along the wall surface to form a plasma that radially implodes into the capillary passage, the ratio of the distance between the spaced regions in the passage and the diametric length of the passage being such that the plasma fills the capillary passage and thence flows out of the first end, the plasma filling the capillary passage forming a capillary electric discharge channel between the spaced regions, the discharge voltage connected to the spaced regions supplying a flow of current from the high voltage power supply means through the plasma in the passage and the ratio of the distance between the spaced regions in the passage and the diametric length of the passage being such as to cause (a) ohmic dissipation in the plasma and transfer of energy to the plasma, (b) a high pressure to be produced in the plasma in response to the ohmic dissipation, the pressure being sufficiently high to cause plasma to flow longitudinally of the passage thence out of the first open end at supersonic speed, and (c) radiation emission and thermal conduction transport of energy from the plasma in the passage to the wall surface to cause the formation of additional plasma that radially implodes and replaces the plasma flowing out of the first end; and means forming an elongated confined bore having an inlet downstream of the first end so that the supersonic pulsed plasma jet flows through the first end into the bore, the pulsed plasma jet flowing into the bore behind the projectile to produce a high pressure gas that acts against the rear of the projectile, the high pressure gas acting on the rear of the projectile having sufficient pressure against the rear of the projectile to accelerate the projectile through a substantial length of the bore.

33. The apparatus of claim 32 wherein the substance is a liquid.

34. The apparatus of claim 30 wherein the bore has a metal wall within which the projectile moves.

35. The apparatus of claim 32 further including dielectric sleeve means surrounding and abutting against exterior wall means of the structure having the interior dielectric ionizable substance, the dielectric sleeve means being formed of means for withstanding the pressure produced by the plasma in the capillary passage.

36. The apparatus of claim 35 further including metal cylinder means surrounding and abutting against exterior wall means of the dielectric sleeve means.

37. A method of accelerating a projectile through an elongated confined bore comprising the steps of generating a high temperature, high pressure pulsed plasma supersonic jet, the jet being formed by: applying a discharge voltage between spaced regions along the length of an interior dielectric wall surface forming a capillary passage having a length between the regions which is great relative to the diametric length of the passage, said discharge voltage being applied while (a) a dielectric ionizable substance is along the wall surface, (b) a first end of the passage is open and (c) a second, opposite end of the passage is arranged so fluid flow from the passage through it is prevented, the discharge voltage causing a breakdown along the wall surface, the breakdown causing the substance along the wall surface to form a plasma that radially implodes into the capillary passage to fill the capillary passage and thence flow out of the first end at supersonic speed, the plasma filing the capillary passage forming a capillary electric discharge channel between the spaced regions, and supplying a flow of current through the plasma in the passage to cause (a) ohmic dissipation in the plasma and transfer of energy from a source of the current flow to the plasma, a high pressure being produced in the plasma in response to the ohmic dissipation, the pressure being sufficiently high to cause plasma to flow longitudinally of the passage and thence out of the first open end at supersonic speed, and (b) radiation emission and thermal conduction transport of energy from the plasma in the passage to the wall surface to cause the formation of additional plasma that radially implodes and replaces the plasma flowing out of the first end; and supplying the plasma flowing at supersonic speed through the first end to the bore behind the projectile to produce a high pressure gas that acts against the rear of the projectile, the high pressure gas acting on the rear of the projectile having sufficient pressure against the rear of the projectile to accelerate the projectile through a substantial length of the bore.

38. The method of claim 37 further comprising the step of cooling the plasma as it flows through the first end into the bore by feeding it through an outwardly flared nozzle located at the first end.

39. In combination, a barrel having a bore through which a projectile is accelerated, means for forming a capillary plasma discharge, a liquid positioned to interact with said discharge to produce a high pressure gas, and means for coupling the high pressure gas to the bore behind the projectile in the bore, the gas as produced and coupled to the bore having sufficient pressure against the rear of the projectile to accelerate the projectile through a substantial length of the bore.

40. The combination of claim 39 wherein the means for forming the capillary plasma discharge includes a structure having an interior dielectric wall surface forming a capillary passage, and high voltage power supply means for applying a discharge voltage between spaced regions along the length of the interior wall surface.

41. The combination of claim 40 wherein first and second ends of the passage are arranged while the discharge voltage from the high voltage power supply means is applied between the spaced regions to respectively enable and prevent the flow of plasma through them, the means for coupling including the first end of the passage, the plasma in the passage forming an electric discharge channel between the spaced regions while the discharge voltage from the high voltage power supply means is applied between the regions, the capillary passage being configured and the spaced regions being positioned so ohmic dissipation occurs in the electric discharge channel in response to the discharge voltage from the high voltage power supply means being applied between the spaced regions, the pressure in the passage being sufficiently high and the capillary passage being configured to cause the plasma in the passage to flow longitudinally in the passage and with supersonic speed through the first end.

42. The combination of claim 39 wherein the bore has a metal wall within which the projectile moves.

43. A method of accelerating a projectile through a bore of a barrel comprising the steps of forming a capillary plasma discharge, interacting a liquid with said discharge to produce a gas having sufficient pressure to accelerate the projectile in the bore, and applying the gas to the bore behind the projectile so that gas has sufficient pressure against the rear of the projectile to accelerate the projectile through a substantial length of the bore.

44. Apparatus for accelerating a projectile comprising means for deriving a high temperature, high pressure plasma from a dielectric ionizable substance, said plasma deriving means including a structure having an interior dielectric wall surface forming a capillary passage, high voltage power supply means for applying a discharge voltage between spaced regions along the length of the interior wall surface while the dielectric ionizable substance extends longitudinally along the wall surface completely between the regions to form a capillary discharge between the regions, the dielectric substance including at least one atomic element that is ionized to form a plasma in response to the discharge voltage from the high voltage power supply means being applied between the spaced regions, the plasma being formed in the passage in response to the substance being ionized between the spaced regions by the discharge voltage from the high voltage power supply means applied between the spaced regions, the diametric length across the passage being short relative to the distance between the spaced regions, the plasma in the passage forming an electric discharge channel between the spaced regions while the discharge voltage from the high voltage power supply means is applied to the regions, the capillary passage being configured and the spaced regions being positioned so ohmic dissipation occurs in the electric discharge channel in response to the discharge voltage from the high voltage power supply means being applied between the spaced regions to produce a high pressure in the passage, the pressure being sufficiently high and the capillary passage being configured to cause the plasma in the passage to flow longitudinally in the passage, and means for coupling the plasma into a confined region behind the projectile to produce a high pressure gas that acts against the rear of the projectile, the high pressure gas acting on the rear of the projectile having sufficient pressure against the rear of the projectile to accelerate the projectile through a substantial length of an elongated passage in which the projectile is located.

45. The apparatus of claim 44 wherein the structure is solid and includes the dielectric and the element is ablated and ionized from the solid on the wall surface to form the plasma.

46. The apparatus of claim 44 further including a high voltage supply connected to the means for applying, the high voltage supply and the means for applying having a first known resistance, the discharge in the channel between the spaced regions while the plasma is formed having a second known resistance, the second resistance exceeding the first resistance so energy is efficiently and rapidly transferred from the high voltage supply to the plasma.

47. Apparatus for accelerating a projectile comprising means for deriving a high temperature, high pressure plasma, said means including: a structure having a capillary passage having a longitudinal axis and an elongated wall having an interior wall surface defining a boundary of the passage, an ablatable dielectric ionizable substance being at and directly behind the wall surface, first and second electrodes at spaced locations along the length of the wall, high voltage power supply means for applying a discharge voltage to the first and second electrodes to form a capillary discharge between the electrodes, the dielectric substance including at least one atomic element that is ionized to form a plasma in response to the discharge voltage from the high voltage power supply means being applied between the electrodes, the plasma being formed by the substance flowing radially into the passage from the wall surface in response to the substance being ionized between the electrodes by the discharge voltage from the high voltage power supply means applied between the electrodes, the diametric length across the passage being short relative to the distance between the electrodes, the plasma in the passage forming an electric discharge channel between the electrodes while the discharge voltage from the high voltage power supply means is applied between the electrodes, the capillary passage being configured and the electrodes being positioned so ohmic dissipation occurs in the electric discharge channel in response to the discharge voltage from the high voltage power supply means being applied between the electrodes to produce a high pressure in the passage, the pressure being sufficiently high and the capillary passage being configured to cause the plasma in the passage to flow longitudinally in the passage; and means for coupling the plasma into a confined region behind the projectile to produce a high pressure gas that acts against the rear of the projectile while the projectile is moving through a passage, the high pressure gas acting on the rear of the projectile having sufficient pressure against the rear of the projectile to accelerate the projectile through a substantial length of the passage through which the projectile is moving.

48. The apparatus of claim 47 further including a high voltage supply connected to the means for applying, the high voltage supply and the means for applying having a first known resistance, the discharge in the channel between the spaced regions while the plasma is formed having a second known resistance, the second resistance exceeding the first resistance so energy is efficiently and rapidly transferred from the high voltage supply to the plasma.

49. Apparatus for accelerating a projectile comprising means for deriving a high temperature, high pressure plasma from a dielectric ionizable substance, said means including: a structure having an interior dielectric wall surface forming a capillary passage, high voltage power supply means for applying a discharge voltage between spaced regions along the length of the interior wall surface while the substance extends longitudinally along the wall surface between the regions to form a capillary discharge between the region, the dielectric substance including at least one atomic element that is ionized to form a plasma in response to a discharge voltage from the high voltage power supply means being applied between the spaced regions, the plasma being formed by the substance flowing radially into the passage from the wall surface in response to the substance being ionized between the spaced regions by the discharge voltage from the high voltage power supply means applied between the spaced regions, the diametric length across the passage being short relative to the distance between the spaced regions, the plasma in the passage forming an electric discharge channel between the spaced regions while the discharge voltage from the high voltage power supply means is applied between the regions, the capillary passage being configured and the spaced regions being positioned so ohmic dissipation occurs in the electric discharge channel in response to the discharge voltage from the high voltage power supply means being applied between the spaced regions to produce a high pressure in the passage, the pressure being sufficiently high and capillary passage being configured to cause the plasma in the passage to flow longitudinally in the passage; and means for coupling the plasma into a confined region behind the projectile to produce a high pressure gas in the confined region that acts against the rear of the projectile, the high pressure gas acting on the rear of the projectile having sufficient pressure against the rear of the projectile to accelerate the projectile through a substantial length of a passage through which the projectile moves.

50. The apparatus of claim 49 further including a high voltage supply connected to the means for applying, the high voltage supply and the means for applying having a first known resistance, the discharge in the channel between the spaced regions while the plasma is formed having a second known resistance, the second resistance exceeding the first resistance so energy is efficiently and rapidly transferred from the high voltage supply to the plasma.

51. Apparatus for accelerating a projectile comprising means for generating a high temperature, high pressure plasma, said means including: a structure having a capillary passage with an interior dielectric wall surface, the passage having a first end, a second end and a longitudinal axis, high voltage power supply means for applying a discharge voltage between spaced regions along the length of the interior dielectric wall surface while (a) a dielectric ionizable substance is along the wall surface, (b) the first end of the passage is open and (c) fluid flow from the passage through the second end of the passage is substantially prevented, the discharge voltage from the high voltage power supply means causing a breakdown along the wall surface, the distance along the longitudinal axis between the spaced regions being great relative to the diametric length of the passage, the breakdown causing the substance along the wall surface to form a plasma that flows radially into the capillary passage, the ratio of the distance between the spaced regions in the passage and the diametric length of the passage being such that the plasma fills the capillary passage and thence flows out of the first end, the plasma filling the capillary passage forming a capillary electric discharge channel between the spaced regions, the discharge voltage from the high voltage power supply means connected to the spaced regions supplying a flow of current through the plasma in the passage, the ratio of the distance between the spaced regions in the passage and the diametric length of the passage being such as to cause (a) ohmic dissipation in the plasma and transfer of energy to the plasma, (b) a high pressure to be produced in the plasma in response to the ohmic dissipation, the pressure being sufficiently high to cause plasma to flow longitudinally of the passage thence through the first end of the passage, and (c) radiation emission and thermal conduction transport of energy from the plasma in the passage to the wall surface to cause the formation of additional plasma that flows radially and replaces the plasma flowing through the first end; and means for coupling the plasma into a confined region behind the projectile to produce a high pressure gas that acts against the rear of the projectile while the projectile is in a passage through which it is accelerated, the high pressure gas acting on the rear of the projectile having sufficient pressure against the rear of the projectile to accelerate the projectile through a substantial length of the passage through which it is accelerated.

52. The apparatus of claim 51 further including a high voltage supply connected to the means for applying, the high voltage supply and the means for applying having a first known resistance, the discharge in the channel between the spaced regions while the plasma is formed having a second known resistance, the second resistance exceeding the first resistance so energy is efficiently and rapidly transferred from the high voltage supply to the plasma.

53. A method of accelerating a projectile through a passage in which the projectile is located comprising the steps of generating a high temperature, high pressure plasma, the plasma being formed by: applying a discharge voltage between spaced regions along the length of an interior dielectric wall surface forming a capillary passage having a length between the regions which is great relative to the diametric length of the passage, said discharge voltage being applied while (a) a dielectric ionizable substance is along the wall surface, (b) a first end of the capillary passage is open and (c) fluid flow from the capillary passage through a second, opposite end of the passage is prevented, the discharge voltage causing a breakdown along the wall surface, the breakdown causing the substance along the wall surface to form a plasma that flows radially into the capillary passage to fill the capillary passage and thence flows out of the first end, the plasma filling the capillary passage forming a capillary electric discharge channel between the spaced regions, and supplying a flow of current through the plasma is the passage to cause (a) ohmic dissipation in the plasma and transfer of energy from a source of the current flow to the plasma, a high pressure being produced in the plasma in response to the ohmic dissipation, the pressure being sufficiently high to cause plasma to flow longitudinally of the passage and thence out of the first end, and (b) radiation emission and thermal conduction transport of energy from the plasma in the passage to the wall surface to cause the formation of additional plasma that flows radially and replaces the plasma flowing out of the first end; and coupling the plasma into a confined region behind the projectile to produce a high pressure gas that acts against the rear of the projectile to accelerate the projectile through the passage in which the projectile is located, the high pressure gas acting on the rear of the projectile having sufficient pressure against the rear of the projectile to accelerate the projectile through a substantial length of the passage in which the projectile is located and through which the projectile moves.

54. A method of accelerating a projectile through a passage in which the projectile is located comprising the steps of generating a high temperature, high pressure plasma, the ejecting form by applying a discharge voltage between spaced regions along the length of an interior dielectric wall surface forming a capillary passage having a length between the regions which is great relative to the diametric length of the passage, said discharge voltage being applied while (a) a dielectric ionizable substance along the wall surface (b) a first end of the capillary passage is open and (c) fluid flow from a second, opposite end of the capillary passage is prevented, the discharge voltage causing a breakdown along the wall surface, the breakdown causing the substance along the wall surface to form a plasma that radially implodes into the capillary passage to fill the capillary passage, the plasma filling the capillary passage forming a capillary electric discharge channel between the spaced regions, and supplying a flow of current through the plasma in the passage to cause ohmic dissipation in the plasma and transfer of energy from a source of the current flow to the plasma, a high pressure being produced in the plasma in response to the ohmic dissipation, the pressure being sufficiently high and the capillary passage being configured to cause the plasma in the passage to flow longitudinally in the passage; and coupling the plasma into a confined region behind the projectile to produce a high pressure gas that acts against the rear of the projectile while it is in the passage through which it travels, the high pressure gas acting on the rear of the projectile having sufficient pressure against the rear of the projectile to accelerate the projectile through a substantial length of the passage through which the projectile is accelerated.

* * * * *